United States Patent [19]

Weber

[11] 4,117,896

[45] Oct. 3, 1978

[54] SOIL SAMPLER

[76] Inventor: Jerome B. Weber, 6300 Lewisand Ct., Raleigh, N.C. 27609

[21] Appl. No.: 814,446

[22] Filed: Jul. 11, 1977

[51] Int. Cl.[2] ..... G01N 1/00

[52] U.S. Cl. ..... 175/84; 73/425.2; 175/308; 175/313

[58] Field of Search ..... 73/425.2; 294/50, 50.5; 175/58, 84, 313, 308; 172/606; 30/130

[56] References Cited

U.S. PATENT DOCUMENTS

| | | | |
|---|---|---|---|
| 370,810 | 10/1887 | Newman | 175/313 X |
| 2,036,433 | 4/1936 | Nisewanger | 294/50.5 |
| 3,324,958 | 6/1967 | Clark | 175/84 |

FOREIGN PATENT DOCUMENTS

| | | | |
|---|---|---|---|
| 640,304 | 4/1962 | Canada | 73/425.2 |

*Primary Examiner*—Ernest R. Purser
*Assistant Examiner*—William F. Pate, III
*Attorney, Agent, or Firm*—Mills & Coats

[57] ABSTRACT

In abstract, a preferred embodiment of this invention is a soil sampler having a specially designed tip for easy penetration, a movable slot cleaner for cutting away surface soil that clings as the sample is taken, and depth markings for allowing accurate gauging of the samples. This invention also includes handles that are off-set 90° from an open soil slot to allow the sampler to be placed horizontally on the ground with the slot upright without danger of tipping.

4 Claims, 5 Drawing Figures

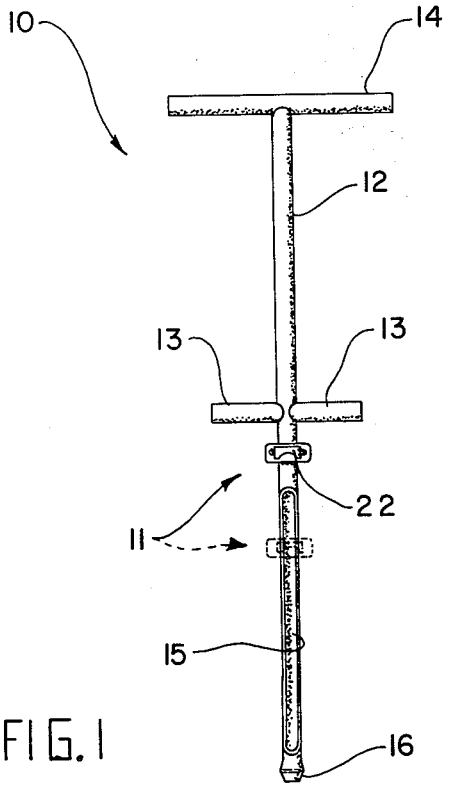
FIG. 1
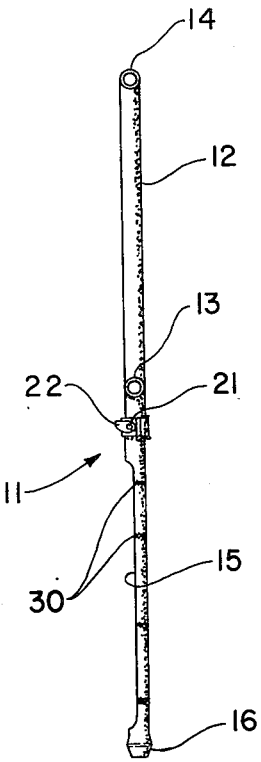
FIG. 2
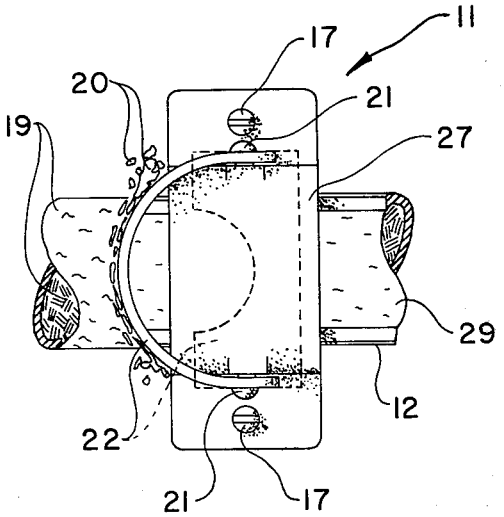
FIG. 3
FIG. 4
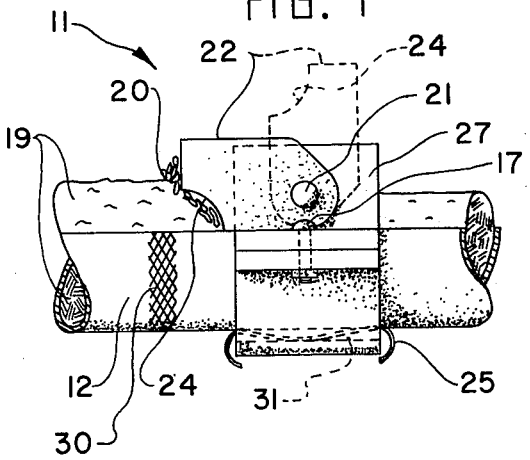
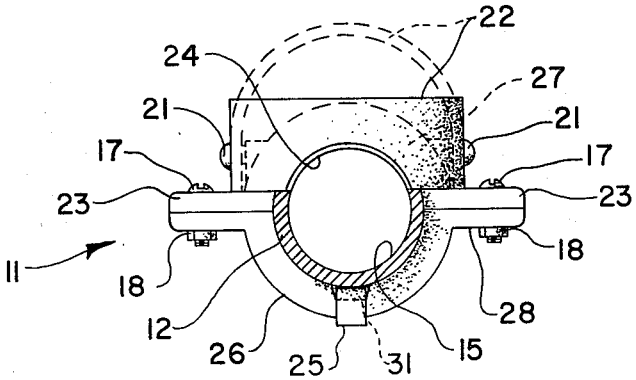
FIG. 5

SOIL SAMPLER

This invention relates to sampling devices and more particularly to soil samplers of the hand manipulated type.

In the past, devices for sampling soils have included types driven into the ground to remove sample plugs. This method is unsuitable, however, for modern soil sampling, particularly when checking for the leaching qualities in a given soil for harmful substances such as pesticides. The primary reason a simple pipe sampler is inadequate is that the substances being checked for may adhere to the sides of the sampler as it is driven into the ground thus contaminating different levels of the core.

With the acute public awareness of the effects of harmful substances to the ecology both above ground and below the ground, testing and sampling have become widespread. Some of the pipe type samplers have been outfitted with foot rests to aid driving the same in the ground and even with slots for aiding in the removal of the core plug. These samplers, however, are very rudimentary and contamination from one strata of the soil sample to another is common.

After much research and study into the above mentioned problems and after actual field use of many different types of samplers, the present invention has been developed to provide a sampler which is simple to use, efficient in operation and will not contaminate the core of soil from one strata or depth to the other. This improved sampler is preferably waist high in height with left and right footrests in "pogue stick fashion". It is constructed of seamless stainless steel to decrease chances of pesticide contamination and to aid in cleaning. The present invention additionally has a specially designed tip for easy penetration of the soil and a movable slot cleaner for cutting away the possibly contaminated outer layer of soil. Finally the present invention includes markings as to depths and has a handle offset from the slot opening 90° to hold said slot upright when the sampler is layed horizontally.

In view of the above, it is an object of the present invention to provide an improved soil sampler which effectively eliminates contamination from one soil level or strata to another.

Another object of the present invention is to provide, in an improved soil sampler, a movable slot cleaner for removing the outer layer of possibly contaminated soil from the sample being obtained.

Another object of the present invention is to provide a soil sampler having an improved tip means for aiding in the penetration of the soil and uniformness in the sample taken therefrom.

A further object of the present invention is to provide a soil sampler having handles offset 90° from the sample slot opening whereby when the sampler is layed on a generally horizontal surface, the slot will be disposed in a generally right position.

An even further object of the present invention is to provide an improved soil sampler with foot and handle means located for easy manipulation by the user of the device.

An additional object of the present invention is to provide a soil sampler constructed of seamless stainless steel tubing to add life to the sampler and to prevent possible residue contamination from one core sample to another.

Another object of the present invention is to provide an improved soil sampler having depths in 10 centimeter increments permanently displayed on the exterior thereof.

Other objects and advantages of the present invention will become apparent and obvious from a study of the following description and the accompanying drawings which are merely illustrative of such invention.

IN THE DRAWINGS

FIG. 1 is a front elevational view of the improved soil sampler of the present invention;

FIG. 2 is a side elevational view of the same;

FIG. 3 is an enlarged fragmentary plane view of the contaminated soil skimming bale portion of the present invention;

FIG. 4 is an elevational view of the portion shown in FIG. 3; and

FIG. 5 is a sectional view of skimming bale portion of the present invention.

With further reference to the drawings, the soil sampler of the present invention, indicated generally at 10, includes a main shaft 12, outwardly projecting, oppositely disposed footrests 13, and a cross bar type handle 14. Main shaft 12, at least in its lower extremity when disposed in the position shown in FIG. 1, includes an elongated soil sample access slot 15 and terminates at the end opposite handle 14 in a bulbous cutting configuration 16.

A sample cleaning means or bale assembly indicated generally at 11, includes a lower bale support bracket 26, and an upper bale support bracket 27. Each of these brackets include an integrally formed, outwardly projecting pair of flanges 28 and 23 respectively. Screws 17 are adapted to pass through the adjacent flanges 23 and 28 and to releasably hold the same juxtaposed to each other through use of nuts 18.

Into the crown of upper bale support bracket 27, as seen particularly clear in the dotted portion of FIG. 5 are bale pivot means such as rivets 1. These rivets pivotably support bale 22 as can be seen clearly in FIGS. 3 through 5. Bale 22 is preferably generally U-shaped in configuration and has a semi-circular cutting edge 24 formed in one side thereof. This cutting edge is so designed to scrapingly remove the upper layer of soil deposited in the access slot 15 as will hereafter be described in greater detail.

Although some looseness between shaft 12 and the surrounding juxtaposed brackets 26 and 27 is desired so that the bale assembly 11 will slide up and down on said shaft, some tension is desired to present the same from loosely sliding when movement is undesired. To allow for the required looseness of fit and yet retain the desired resistance to undesired movement, a spring 25 has been provided in slot 31 on the inner surface of bracket 26. As can clearly be seen in FIGS. 4 and 5, this spring will bias the bale assembly in a snug and yet readily slidable relation with shaft 12.

On the lower portion of shaft 12 and on the side thereof opposite slot 15 are a plurality of depth gauge markings 30. These markings are preferably at predetermined intervals beginning with the lower extremity of bulbous portion 16. In actual practice, and to conform to present measuring standards, these markings would be at 10 centimeter intervals. Thus the user of the sampler 10 can at a glance determine whether the sampler has penetrated the soil to a depth of 10, 20, etc., centimeters, or through interpolation, intervals therebetween.

To use the sampler of the present invention, the outer tip of bulbous portion 16 is placed on the top of the soil to be sampled (not shown) and using handle 14 and footrests 13, the sampler is forced into the ground to the desired depth as read in indicia 30. The sampler 10 is then pulled out of the soil and a soil sample or core 19 is removed therewith.

Since, as the sample 10 is pulled out of the soil being sampled, pesticides or other contaminating substances near the surface will possibly come into contact with deeper strata, they will contaminate the top layer of soil in slot 15. To uniformly remove this possibly contaminated soil layer 20, bale 22 is flipped over to the position shown in solid lines in FIG. 4. The entire bale assembly 11 is then slid down shaft 12 towards bulbous end 16 and as it comes into contact with the sloping end of slot 15, it will began to remove the contaminated soil layer and will continue to do so until all of such soil is removed to the sloping end of slot 15 adjacent portion 16. A smooth, clean, uncontaminated surface is then exposed in slot 15 which is thus ready for testing to determine permeation of pesticides or for whatever other purpose the user of the sampler desires.

During the removal of the contaminated surface soil 20, as well as during the sample testing procedures, the sampler 10 can be placed on any convenient generally horizontal surface such as the ground, a table, or the like. Because of the arrangement of handle 14 and footrests 13 relative to slot 15, such slot can be disposed upwardly on such surface and will be prevented from rolling because of said handle and footrests.

Because of the seamless stainless steel tube construction of the sampler of the present invention, once the soil sample has been tested or otherwise served its purpose, the same can very quickly and readily be removed from the sampler 15 and the same can be wiped, washed or otherwise readily cleaned to remove residue from the previous sample prior to the next sampling being taken.

From the foregoing, it is obvious that the present invention provides a sturdy yet relatively inexpensive soil sampler which effectively eliminates the problem of sample contamination from one strata or depth to another while maintaining accuracy in determining the penetration depths being evaluated.

The terms "top", "bottom", and so forth have been used herein merely for convenience to describe the soil sampler and its parts as oriented in the drawings. It is to be understood, however, that these terms are in no way limiting to the invention since the sampler may obviously be disposed in many different positions when in use.

The present invention may, of course, be carried out in other specific ways than those herein set forth without departing from the spirit and essential characteristics of the same. The present embodiments are, therefore, to be considered in all respects as illustrative and not restrictive and all changes coming within the meaning and equivalency range of the appended claims are intended to be embraced therein.

What is claimed is:

1. A soil type sampling device comprising: a tubular like main shaft being open at one end and having a handle means attached adjacent the other end; an elongated, slot-like opening in said shaft adjacent said open end; and a soil sample surface removal means slidably mounted on said shaft adjacent said slot and including a shaft encircling bracket means pivotably mounting a bale like surface scrapper whereby surface soil of said soil sample which may become contaminated can be removed to expose the true sample core.

2. The sampling device of claim 1 wherein the open end of said shaft is bulbous.

3. The sampling device of claim 1 wherein a footrest is attached to said shaft intermediate its ends.

4. The sampling device of claim 1 wherein said handle is so disposed relative to said slot in said shaft that when said shaft and handle are placed on a generally horizontal surface, said slot will be disposed generally uprightly whereby testing of the soil sample in the slot can be accomplished without danger of the same accidentally falling out.

* * * * *